US007323820B2

(12) United States Patent
Jüngst et al.

(10) Patent No.: US 7,323,820 B2
(45) Date of Patent: Jan. 29, 2008

(54) METAL HALIDE LAMP

(75) Inventors: Stefan Jüngst, Zorneding (DE); Klaus Stockwald, Germering (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 130 days.

(21) Appl. No.: 11/364,071

(22) Filed: Mar. 1, 2006

(65) Prior Publication Data

US 2006/0208643 A1 Sep. 21, 2006

(30) Foreign Application Priority Data

Mar. 21, 2005 (DE) ..... 10 2005 013 003

(51) Int. Cl.
*H01J 17/20* (2006.01)
*H01J 61/18* (2006.01)

(52) U.S. Cl. ..... 313/638; 313/637; 313/639; 313/640; 313/641; 313/642

(58) Field of Classification Search ..... 313/624–643, 313/25, 248, 318.01
See application file for complete search history.

(56) References Cited

U.S. PATENT DOCUMENTS

| | | | | |
|---|---|---|---|---|
| 4,243,906 | A * | 1/1981 | Wilson | 313/623 |
| 5,936,351 | A | 8/1999 | Lang | |
| 6,218,789 | B1 | 4/2001 | Takahashi et al. | |
| 6,483,241 | B1 | 11/2002 | Stockwald | |
| 6,501,220 | B1 * | 12/2002 | Lambrechts et al. | 313/571 |
| 6,646,379 | B1 * | 11/2003 | Nohara et al. | 313/623 |
| 7,245,081 | B2 * | 7/2007 | Ashida et al. | 313/637 |
| 2003/0015949 | A1 * | 1/2003 | Higashi et al. | 313/17 |
| 2003/0020408 | A1 * | 1/2003 | Higashi et al. | 313/637 |
| 2005/0073257 | A1 * | 4/2005 | Takeuchi et al. | 313/634 |
| 2006/0028113 | A1 * | 2/2006 | Arndt et al. | 313/318.01 |
| 2006/0049765 | A1 * | 3/2006 | Ota et al. | 313/638 |
| 2006/0164016 | A1 * | 7/2006 | Rintamaki et al. | 313/638 |
| 2006/0238127 | A1 * | 10/2006 | Van Esveld et al. | 313/627 |

* cited by examiner

*Primary Examiner*—Mariceli Santiago
*Assistant Examiner*—José M Diaz
(74) *Attorney, Agent, or Firm*—William E. Meyer

(57) ABSTRACT

The metal halide lamp has a ceramic discharge vessel and contains two groups of metal halides: a first group made up of the emitters and a second group made up of the wetters. The second group comprises at least one of the metal halides of Mg or Yb.

12 Claims, 4 Drawing Sheets

METAL HALIDE LAMP

TECHNICAL FIELD

The invention is based on a metal halide lamp having a ceramic discharge vessel, the inner contour of which is convex in form with rounded ends, wherein the discharge vessel contains a fill which comprises starting gas, preferably as noble gas, mercury and metal halides, the metal halides comprising two groups, namely the first group made up of the emitters and the second group made up of the wetters. These are in particular high-pressure discharge lamps with ceramic discharge vessel for a neutral-white luminous color.

BACKGROUND ART

U.S. Pat. No. 6,218,789 has already disclosed a metal halide lamp. In that document, a halide of Yb is used to generate molecular radiation. The discharge vessel consists of quartz glass.

U.S. Pat. No. 6,483,241 has disclosed a mercury-free metal halide lamp which uses Mg iodide as fill in a ceramic discharge vessel.

DISCLOSURE OF THE INVENTION

It is an object of the present invention to reduce the color scatter in metal halide lamps with a convex geometry of the discharge vessel, in particular with fills used for neutral-white luminous colors.

This object is achieved by the following features: the second group at least comprises one of the halides of Mg and Yb, with the proportion of these constituents of the second group amounting to at least 15 mol %, with the option for Ca halide to be an additional constituent of the second group, in which case the proportion of the entire second group amounts to at most 55 mol % of the metal halides.

Particularly advantageous configurations are given in the dependent claims.

The color scatter of metal halide lamps has long been the focus of attempts to improve quality. This problem in itself appeared to have already been solved, since a corresponding fill composition is known for a cylindrical geometry of the discharge vessel. In this case, certain ratios for the surface area also have to be taken into account.

Surprisingly, however, it has emerged that these established approaches aimed at finding a solution fail if, instead of a cylindrical geometry, the more isothermal convex geometry is used. This is to be understood as meaning a discharge vessel with rounded corners, which has either a straight center part or an elliptically shaped volume. The rounding may be circular, elliptical or of some other shape. This problem is particularly pronounced when using fills for a neutral-white luminous color, i.e. for a color temperature from approximately 4000 to 4900 K.

According to the invention, therefore, the inner contour is convex in form with rounded ends, while the discharge vessel contains a fill which comprises starting gas, preferably as noble gas, mercury and metal halides, the metal halides comprising two groups, namely the first group made up of the emitters and the second group made up of the wetters, and wherein the second group at least comprises one of the halides of Mg and Yb, with the proportion of these constituents of the second group amounting to at least 15 mol %, with the option for Ca halide to be an additional constituent of the second group, in which case the proportion of the entire second group amounts to at most 55 mol % of the metal halides.

It is particularly preferable to add halide of Yb, in particular in a proportion of from 10 to 60 mol %, preferably 15 to 45 mol %. In particular, a fraction of the Yb, preferably up to 50%, may be replaced by halides of Mg. A suitable halogen in this context is preferably iodine, but bromine may also be suitable, in particular as a fraction which replaces iodine, preferably up to 30%.

Operation may be implemented at electronic ballasts or conventional ballasts.

Metal halide lamps with convex ceramic burners, in particular to set a neutral-white luminous color (NDL, typically 4000 to 4900 K), require a relatively high proportion of RE iodide in the metal halide melt. RE here stands for rare earths. The term burner means discharge vessel.

Therefore, over the illumination time and service life of the lamp, there is an increase in the restarting peak voltage UI and the crest factor (UIs/UIrms), which can lead to critical lamp conditions and premature failure through extinction of the lamp.

In the case of cylindrical discharge vessels, this problem is normally remedied by the addition of $CaI_2$, which is known per se. However, it has emerged that the wetting properties of the metal halide melt changes significantly beyond typical $CaI_2$ concentrations of at least 20 mol %, in particular 25 mol %, since in the operating state the wetting angle of the melt on the lamp components is increased.

In the case of lamps with high power densities, the altered fill wetting results in a relatively high individual scatter of the desired color temperature as a result of fluctuating extent of the fill wetting on the inner wall of the discharge vessel. In this context, the power density p is to be understood as meaning the power P of the lamp in W per unit area S in $mm^2$, differentiated between the inner and outer power density $p_{in}=P/S_{in}$ and $p_{out}=P/S_{out}$ (where S respectively denotes the surface area on the inside (in) and outside (out) of the discharge vessel) and typical surface area ratios between the inner and outer surfaces eo_back in the electrode back space (eo_back: =total space or burner extent in the interior and exterior behind the electrode tip, including the capillary with regard to the neck region) to the total surface area of the discharge vessel (S inter_deo/Si_tot; So, back_deo/Si_tot), as is the case with convex lamps with hemispherical end shapes.

Typical ratios for both shapes are explained in Table 1 below:

| Parameter | | cyl. DV | convex DV |
|---|---|---|---|
| Nominal power | Pnom/W | 150.00 | 150.00 |
| Eo gap | eo_d/mm | 9.00 | 9.20 |
| Inner surface | Sin/mm2 | 500.00 | 685.00 |
| Outer surface | Sout/mm2 | 900.00 | 798.00 |
| Resulting ratio | Sout/Sin | 1.80 | 1.16 |
| | Sin, inter_deo/mm2 | 257.00 | 404.00 |
| | Sin, back_eo/mm2 | 243.00 | 281.00 |
| | Sin, back/Sin, inter | 0.95 | 0.70 |
| | Sout_inter_deo/mm2 | 324.00 | 451.00 |
| | Sout_back_deo/mm2 | 576.00 | 347.00 |
| | Sout_back/Sout, inter | 1.78 | 0.77 |
| | P/Sin[W/cm2] | 30.00 | 21.90 |
| | P/Sout[W/cm2] | 16.67 | 18.80 |

On account of the different surface area ratios, which are substantially responsible for dividing the power transported by radiation transport and heat conduction between the inner wall and from the outer wall of the discharge vessel to the environment, a very homogenous temperature distribution is formed with convex discharge vessels.

For example, the ratio of outer surface area to inner surface area is typically from 1.6 to 2.0 when using a cylindrical geometry (in Table 1 it is 1.8), whereas when using a convex geometry this ratio is typically from 1.0 to 1.35 only (in Table 1 it is 1.16). The difference between comparable power stages is typically 50% (in Table 1 it is 55%). Furthermore, the ratio of the inner surface area which lies behind the electrode tips to the inner surface area which lies between the electrodes is 0.95 with a cylindrical geometry but just 0.7 in the case of a convex geometry, i.e. is 35% greater with a cylindrical geometry. The ratio of outer surface area Sback which lies behind the electrodes to the outer surface area Seo which lies between the electrodes is 1.78 in the case of a cylindrical geometry but only 0.77 in the case of a convex geometry, i.e. is 131% greater in the case of a cylindrical geometry.

The result of this is that under certain circumstances, if a defined wetting angle of the metal halide fill is exceeded, a boosted distribution of the fill into the interior of the burner occurs. This leads to increased individual scatter of the color temperature and consequently to a corresponding scatter in the electrical characteristic variables.

The individual scatter of the color temperature is now reduced by an altered fill composition, so as to produce a defined degree of fill wetting on the inner wall of the discharge vessel in the electrode back space. At the same time, the electrical lamp data, such as restarting peak and crest factor, are as a result comparable to fills with a high $CaI_2$ fraction (low activity of the RE iodides).

A typical target value for the color temperature is, for example, 4000 to 4400 K. The novel fill reduces both the scatter in the color temperature, with only a slight deviation from the Planckian locus in the CIE diagram and with a low crest factor.

An acceptable variation range δ after 100 h illumination time for the color temperature Tn and the crest factor Cr is $$\delta Tn \leqq \pm 75\text{K},\ Cr = UI_s/UI_{rms} < 1.9.$$

The addition of $CaI_2$ in metal halide melts to set NDL color temperatures is typically 40-50 mol %, thereby reducing the activity of the trivalent RE iodides, which over the illumination time and service life leads to a reduction in the reaction rates of the RE halides with the lamp constituents and therefore limits the formation of free iodine. This in turn restricts the increase in the restarting peak voltage and the crest factor.

To achieve a comparable effect with convex discharge vessels, according to the invention metal halide additives are substituted for proportions of $CaI_2$ in the fill, without altering the main fraction of the RE halide concentration and therefore the chemical activity thereof. The result is a change in the degree of wetting, which produces a defined fill distribution in the electrode back space of the lamps, with a low individual scatter occurring when setting the color temperature.

It has been found that the divalent metal halide components of Yb and if appropriate Mg, preferably $MgI_2$ and $YbI_2$, are suitable for completely or partially, but at least to an extent of 20 mol % in the total fill and therefore 20/45 of the molar $CaI_2$ quantity, performing the role of the $CaI_2$.

It is preferable to use a quantity of 20-25 mol % $YbI_2$ while maintaining 20 to 25 mol % $CaI_2$ or to simultaneously use halides of Mg and Yb, in such a way that, in particular when using the iodides $MgI_2$ and $YbI_2$, the total quantity of $YbI_2$+$MgI_2$ forms a proportion of at least 20 mol %, in particular 20 to 35 mol %, of the metal halides, and together with $CaI_2$ form a total proportion of 40-50 mol % of the total fill of metal halides.

BRIEF DESCRIPTION OF THE DRAWINGS

In the text which follows, the invention is to be explained in more detail on the basis of a number of exemplary embodiments. In the drawing.

BEST MODE FOR CARRYING OUT THE INVENTION

Figure 1:
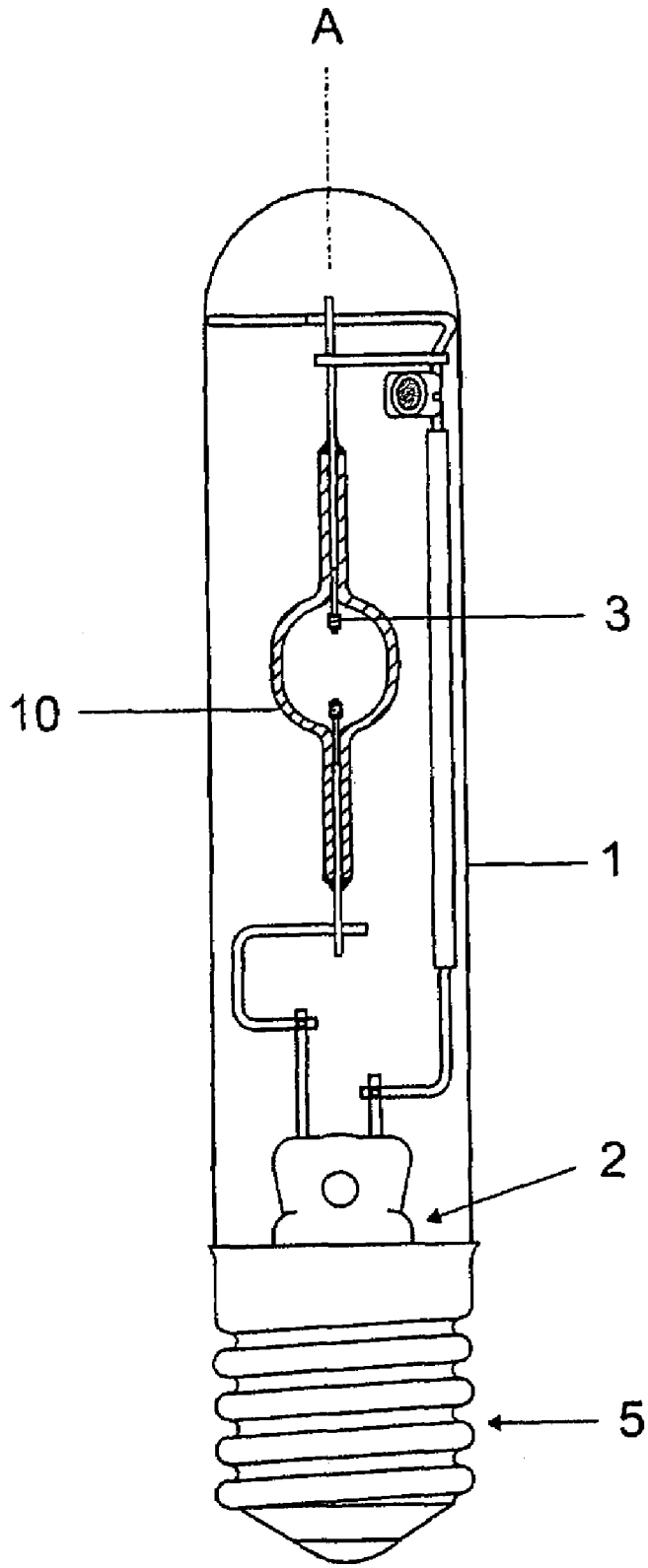
FIG. 1 shows a diagrammatic view of a discharge vessel of a high-pressure lamp.

FIG. 1 shows a metal halide lamp having an outer bulb 1 made from hard glass or quartz glass, which has a longitudinal axis and is closed on one side by a fused-in plate 2. At the fused-in plate 2, two supply conductors lead to the outside (not shown). They end in a cap 5. A ceramic convex discharge vessel 10 made from $Al_2O_3$ which is sealed on two sides and contains a fill of metal halides is fitted axially in the outer bulb.

Figure 2:
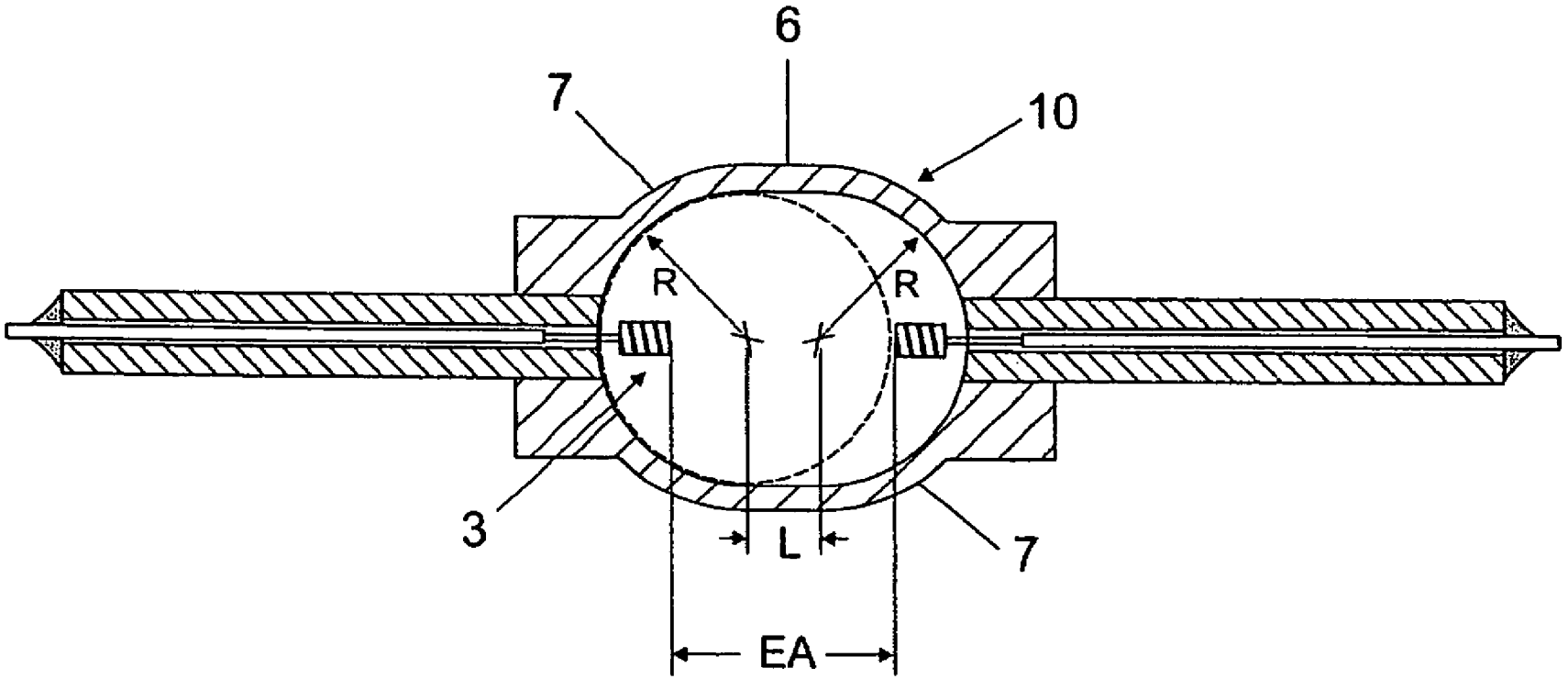
FIG. 2 shows a particularly suitable convex discharge vessel.

The discharge vessel 10 may in particular be internally spherical or elliptical or may deviate from the spherical geometry by virtue of having a short cylindrical center piece between the half-shells of the sphere. In particular, it has the dimensions shown in FIG. 2, as described in EP A 841 687. The contour of the inner wall is in this case as follows:

- the contour has a substantially straight cylindrical center part 6 of length L and internal radius R, as well as two substantially hemispherical end pieces 7 of the same radius R,
- the length of the cylindrical center part is less than or equal to its internal radius:

$$L \leqq R,$$

- the internal length of the discharge vessel is at least 10% greater than the electrode gap EA:

$$2R+L \geqq 1.1EA,$$

- the diameter (2R) of the discharge vessel corresponds to at least 80% of the electrode gap EA; at the same time, it may have a length of at most 150% of the electrode gap EA:

$$1.5EA \geqq 2R \geqq 0.8EA.$$

Specifically, in this example, Lcyl=1 mm, L=15 mm and R=7 mm.

The ratio of the external radius to the internal radius is Ra/Ri=7.8/7=1.11. The ratio of internal radius/cylinder length is Ri/Lcyl=7/1=7. The electrode gap is 9.2 mm.

Electrodes 3 project into the discharge vessel. The electrode gap EA and the length L of the discharge vessel are in a ratio EA/L=9.2/15=0.61.

An ignitable gas selected from the group consisting of the noble gases is located in the discharge vessel at a cold fill pressure of 300 mbar. The discharge vessel also contains mercury and a mixture of metal halides consisting of the following molar compositions (mol %) in accordance with Table 2 below:

| | NaI | TlI | TmI3 | DyI3 | HoI3 | CaI2 | MgI2 | YbI2 |
|---|---|---|---|---|---|---|---|---|
| Reference fill (Ref): | 15.7 | 15.5 | 7.3 | 7.3 | 7.3 | 46.9 | 0.0 | 0.0 |
| 1. First exemplary embodiment AB1: | 15.7 | 15.5 | 7.3 | 7.3 | 7.3 | 31.3 | 0.0 | 15.6 |
| 2. Second exemplary embodiment AB2: | 15.7 | 15.5 | 7.3 | 7.3 | 7.3 | 15.7 | 0.0 | 31.2 |
| 3. Third exemplary embodiment AB3: | 15.7 | 15.5 | 7.3 | 7.3 | 7.3 | 0.0 | 0.0 | 46.9 |
| 4. Fourth exemplary embodiment AB4: | 15.7 | 15.5 | 7.3 | 7.3 | 7.3 | 15.6 | 15.6 | 15.6 |

The power consumed is in a range from 140 to 150 W. If the ratio of the power to the external surface area of the discharge vessel is considered, the wall loading is typically in a ratio of from 17.2 to 18.45 W/cm$^2$.

If the ratio of the power to the internal surface area of the discharge vessel is considered, the wall loading is typically in a ratio of from 21.2 to 22.75 W/cm$^2$.

The color temperature for these lamps is in each case approximately 4200 K.

The exemplary embodiments reveal a considerable reduction in the scatter in the color temperature and the crest factor. Evaluation after an illumination time of 100 hours gives the following result:

TABLE 3

| Fill/illumination position | Mean value Cr | St. dev. Cr | Mean Tn (K) | St.dev. Tn |
|---|---|---|---|---|
| Ref. vert | 1.741 | 0.057 | 4161 | 128 |
| Ref. hor | 1.787 | 0.045 | 4052 | 44 |
| AB1 vert | 1.819 | 0.036 | 3958 | 122 |
| Ab1 hor | 1.868 | 0.077 | 4034 | 54 |
| AB2 vert | 1.770 | 0.048 | 4195 | 60 |
| AB2 hor | 1.856 | 0.040 | 4107 | 45 |
| AB3 vert | 1.723 | 0.056 | 4378 | 99 |
| AB3 hor | 1.822 | 0.035 | 4276 | 81 |
| AB4 vert | 1.903 | 0.032 | 4089 | 93 |
| AB4 hor | 1.983 | 0.029 | 4055 | 44 |

This table in each case shows the mean value and the standard deviation for the crest factor Cr and the color temperature Tn.

The lowest scatter in the color temperature combined, at the same time, with an acceptable crest factor is found in exemplary embodiment 2, in which 66% of the $CaI_2$ molar fraction is substituted by $YbI_2$ (totalling 31.2 mol % in the overall mixture).

A similar behavior with regard to the reduction in the scatter of the color temperature can be achieved if $CaI_2$ is partially substituted by $MgI_2$. The effectiveness of the admixture in reducing the scatter in the color temperature results from the reduction in the wetting angle of the molten metal halide melt on the aluminum oxide ceramic. The effectiveness in reducing the scatter in the color temperature, both with $MgI_2$ and with $YbI_2$, becomes significant once at least 15 mol % has been added, preferably 20-35 mol %, in the metal halide melt. The proportion should not exceed 55 mol %.

This is linked to the replacement of the $CaI_2$, which improves the read fraction and may typically be present up to within the range from approx. 40-45 mol % as a constituent of MH fills for a color temperature of 4000 K.

The $CaI_2$ may be replaced completely or partially by the substances $YbI_2$ or $MgI_2$, individually or together, preferably in a proportion of approx. 50-70% of the Ca iodide. This means that optimum conditions are achieved in fills with typical contents of 15-25 mol % formed from at least one of the metal halides $DyI_3$, $HoI_3$, $TmI_3$, and that the proportions of the group of the wetters made up of $MgI_2$ and $YbI_2$ should be in the range from 15 to 55 mol %, optionally including $CaI_2$, preferably in the range from 15-35 mol %, in the overall mixture.

Figure 3:
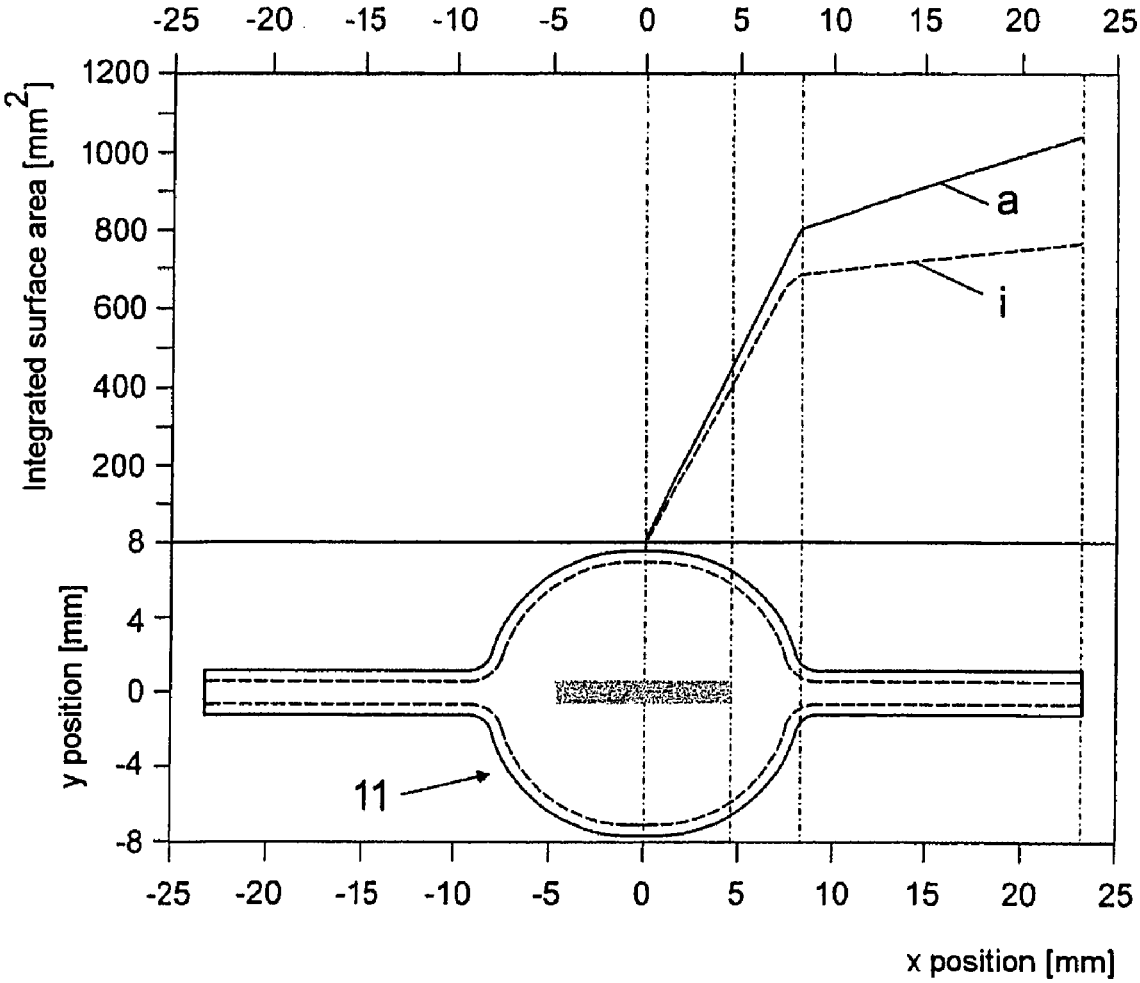
FIG. 3 shows the inner and outer surface areas of a convex discharge vessel.
Figure 4:
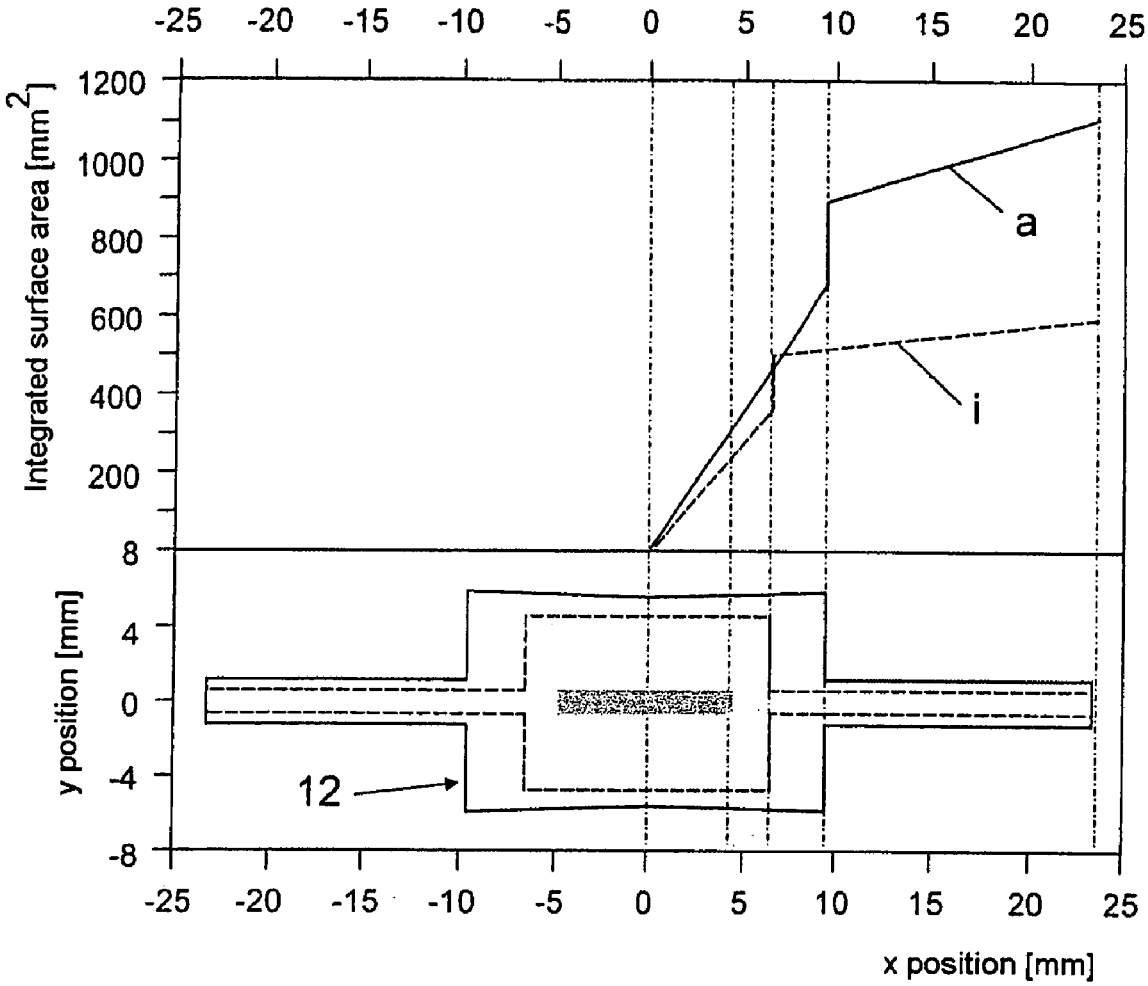
FIG. 4 shows the inner and outer surface areas of a cylindrical discharge vessel.

FIGS. 3 and 4 show a comparison between a convex discharge vessel (11) and a cylindrical discharge vessel (12) with regard to the inner and outer surface areas. Solid lines denote the outer surface and dashed lines the inner surface. The illustration of the profile of the inner and outer surface areas is based on a symmetrical integration from the lamp center (x position 0) to the capillary ends (x position 23) (upper part of the figure in each case). The lower part of the figure in each case shows examples of inner and outer contours for convex and cylindrical geometries of the discharge vessel.

It can be seen that in the case of the convex discharge vessel, there is a smooth relationship between the integrated inner surface area (i) and outer surface area (a), and the two are closely related. In the case of the cylindrical discharge vessel, the relationship involves sudden jumps, cannot always be differentiated and the relationship alters. In particular, the inner surface area may temporarily even be greater than the external surface area.

What is claimed is:

1. A metal halide lamp having a ceramic discharge vessel, the inner contour of which is convex in form with rounded ends, wherein the discharge vessel contains a fill which comprises starting gas, preferably as noble gas, mercury and metal halides, the metal halides comprising two groups, namely the first group made up of the emitters and the second group made up of the wetters, wherein the second group at least comprises one of the halides of Mg and Yb, with the proportion of these constituents of the second group amounting to at least 15 mol %, with the option for Ca halide to be an additional constituent of the second group, in which case the proportion of the entire second group amounts to at most 55 mol % of the metal halides, wherein the first group comprises at least halides of the rare earths, wherein the first group comprises halides of Na and/or thallium as an addition, wherein the proportion of the additions amounts to at most 34 mol % of the metal halides, in particular in a mixture of from 1:2 to 2:1 between N and Tl.

2. The metal halide lamp as claimed in claim 1, wherein the color temperature is between 4000 and 4900 K.

3. The metal halide lamp as claimed in claim 1, wherein at least one of the elements Dy, Ho, Tm is used as rare earth.

4. The metal halide lamp as claimed in claim 1, wherein the proportion of the rare earths in the metal halides amounts to at most 25 mol %, in particular at least 15 mol %.

5. The metal halide lamp as claimed in claim 1, wherein Yb is introduced as $YbI_2$, preferably in a proportion of from 15 to 45 mol % of the metal halides.

6. The metal halide lamp as claimed in claim 1, wherein Ca is introduced as $CaI_2$, preferably in a proportion of from 0.1 to 30 mol % of the metal halides.

7. The metal halide lamp as claimed in claim 1, wherein Mg is introduced as $MgI_2$, preferably in a proportion of from 0.1 to 15 mol % of the metal halides.

8. A metal halide lamp having a ceramic discharge vessel, the inner contour of which is convex in form with rounded ends, wherein the discharge vessel contains a fill which comprises starting gas, preferably as noble gas, mercury and metal halides, the metal halides comprising two groups, namely the first group made up of the emitters and the second group made up of the wetters, wherein the second group at least comprises one of the halides of Mg and Yb, with the proportion of these constituents of the second group amounting to at least 15 mol %, with the option for Ca halide to be an additional constituent of the second group, in which case the proportion of the entire second group amounts to at most 55 mol % of the metal halides, wherein the discharge vessel has the following dimensions:

the inner contour has a substantially straight cylindrical center part of length L and internal radius R, as well as two substantially hemispherical end pieces of the same radius R, the length of the cylindrical center part is less than or equal to its internal radius:

$$L \leqq R,$$

the internal length of the discharge vessel is at least 10% greater than the electrode gap EA:

$$2R+L \geqq 1.1EA,$$

the diameter (2R) of the discharge vessel corresponds to at least 80% of the electrode gap EA; at the same time, it may have a length of at most 150% of the electrode gap EA:

$$1.5EA \geqq 2R \geqq 0.8EA.$$

9. The metal halide lamp as claimed in claim 8, wherein the ratio of the lamp power to surface area adopts the following values: outer surface: 16-19 $W/cm^2$, inner surface 20-23 $W/cm^2$.

10. The metal halide lamp as claimed in claim 8, wherein the relationship Sin/Sout<1.3 applies.

11. The metal halide lamp as claimed in claim 8, wherein the relationship Sin,back_eod/Sin,inter_eod<=0.85 applies.

12. The metal halide lamp as claimed in claim 8, wherein the relationship Sout,back_eod/Sout,inter_eod<=1.4 applies.

* * * * *